US006367675B1

(12) United States Patent
Woerner

(10) Patent No.: US 6,367,675 B1
(45) Date of Patent: Apr. 9, 2002

(54) YARN BLOW-IN VALVE

(75) Inventor: Christoph Woerner, Baiersbronn (DE)

(73) Assignee: Memminger-IRO GmbH, Dornstetten (DE)

( * ) Notice: Subject to any disclaimer, the term of this patent is extended or adjusted under 35 U.S.C. 154(b) by 0 days.

(21) Appl. No.: 09/438,097

(22) Filed: Nov. 10, 1999

(30) Foreign Application Priority Data

Nov. 11, 1998 (DE) ..... 198 51 957

(51) Int. Cl.[7] ..... B65H 20/00; B65H 57/00
(52) U.S. Cl. ..... 226/97.4; 242/157 R; 242/615.3
(58) Field of Search ..... 226/97.4; 242/157 R, 242/615.3, 131; 66/125 R; 251/150, 151, 152

(56) References Cited

U.S. PATENT DOCUMENTS 1,874,541 A * 8/1932 Jonsson ..... 251/150 X
3,633,808 A * 1/1972 Svaty ..... 226/97.4 X
4,776,369 A * 10/1988 Lardner et al. ..... 251/152 X
5,024,393 A * 6/1991 Gutschmit ..... 242/131
5,191,680 A * 3/1993 Kaneko et al. ..... 226/97.4 X
5,323,982 A 6/1994 Ligon et al.

FOREIGN PATENT DOCUMENTS

| | | |
|---|---|---|
| DE | 1 660 671 | 12/1970 |
| DE | 2 059 199 | 6/1971 |
| EP | 0 454 141 A2 | 10/1991 |
| FR | 1045449 | 11/1953 |
| GB | 2 019 450 A | 10/1979 |

* cited by examiner

*Primary Examiner*—Donald P. Walsh
*Assistant Examiner*—Minh-Chau Pham
(74) *Attorney, Agent, or Firm*—Frishauf, Holtz, Goodman, Langer & Chick, P.C.

(57) ABSTRACT

A yarn blow-in valve is constructed of a base body and a connecting piece. This permits locating a compressed air line behind a cover wall, assembling the yarn blow-in valve, and then coupling it to the air line in a readily performed manner. In order to facilitate the assembly, a coupling device is provided to connect the base body with the connecting piece.

14 Claims, 4 Drawing Sheets

YARN BLOW-IN VALVE

FIELD OF THE INVENTION

The invention relates to a yarn blow-in valve, in particular for the introduction of textile yarn into yarn guide tubes, such as can be provided for the transfer of yarn from a bobbin creel to a textile machine.

BACKGROUND OF THE INVENTION

Bobbin creels, which as a rule support a large number of yarn bobbins, are often used for making yarn available to textile machines. A yarn runs from every yarn bobbin to the textile machine which is to be supplied with yarn. Tubes are often used for guiding the yarn, wherein one yarn runs through each tube. Each tube can be several meters long. The yarn is mostly pulled into these tubes by means of compressed air.

For this purpose a yarn blow-in valve is known, for example from U.S. Pat. No. 5,024,393. An air nozzle is arranged opposite the open end of a yarn guide tube, from which compressed air can be expelled, controlled by a valve, which then flushes the yarn into the yarn guide tube. The yarn blow-in valve is located in a compressed air line. The compressed air line, the yarn guide tube and the yarn blow-in valve are mounted outside on a support.

The air nozzle of the yarn blow-in valve is arranged opposite the open end of the yarn guide tube and laterally offset in respect to it in order to permit a lateral guidance of the yarn to the open end of the yarn guide tube. The operation is fixed, for example for right-handed people, because of the asymmetric arrangement.

As a rule, creels for bobbins are assembled at the place of their use from prefabricated elements. The assembly and equipping of the creels with all required elements, such as yarn blow-in valves, for example, should be accomplished in a simple, assembly-friendly manner. Moreover, this should result in a structure which is as accessible as possible. Furthermore, it is necessary to take into consideration that creels are subject to contamination because of the deposition of fluff, the same as almost all devices in textile mills. It is also necessary to counteract this.

SUMMARY OF THE INVENTION

One object of the invention is to provide a yarn blow-in valve which is simple to mount.

This and other objects are attained in accordance with one aspect of the invention directed to a yarn blow-in valve constructed in at least two pieces and divided into a base body and a connecting piece. These can be connected with each other by means of a coupling device. In this divided construction, the connecting piece is preferably associated with a compressed air line, and the base body is preferably associated with a yarn guide tube. In this way the connecting piece can first be separately mounted in the compressed air line before it is coupled with the base body, which was also separately mounted. This makes assembly simpler. Moreover, the twopiece embodiment permits the placement of the compressed air line, together with connecting elements, in the interior of hollow profiled sections, for example, or also in profiled sections which are open on one side, such as U-shaped profiled sections or the like which, for example, are used as support elements for the creel or are provided thereon. In this way the compressed air line can be placed so that it is not visible. By means of this the total construction becomes smoother, and fewer hard-to-access surfaces or surface areas result, on which deposits of flux can collect.

The coupling device provides a connection of an air delivery conduit, which is provided with the connecting piece, with an air conduit formed in the base body, and in addition provides the mechanical connection between the connecting piece and the base body. While the connecting piece is used for a connection with the compressed air line which, for example, consists of hoses, an air valve, which leads to a blow nozzle, is provided on the base body. The two parts of the yarn blow-in valve, i.e. the base body and the connecting piece, are arranged on both sides of a wall of the support element. In this case, one member of a coupling projects through an opening in the wall. Essentially there is no necessity for accuracy and precision in connection with the latter, or freedom from burrs, rigidity, etc. More or less play can easily be allowed here without adversely affecting the function. The coupling members, which are preferably complementary, are sealed against each other in a fluid-tight manner, regardless of the size or precision of the opening.

It is considered to be particularly useful to embody the coupling members in such a way that the coupling can be released. A releasable coupling can be constituted, for example, by a snap connection with one or several locking tongues, which are a part of the coupling members. These can secure the base body onto the connecting piece or the connecting piece onto the base body. The coupling device can simultaneously be used for fixing the yarn blow-in valve in place on the support, for example if the support is clamped between the connecting piece and the base body. Alternatively, it is possible to provide additional fastening means on the base body and/or the connecting piece. The fastening means can be screws, locking pins, snap-in tongues, or the like.

In an advantageous embodiment, the coupling members can be rotated in respect to each other, at least over a limited rotation range. Essentially, the axis of rotation is oriented transversely to the passage and parallel with the air delivery conduit. Because of this it is possible to pass hoses for delivering compressed air around the yarn guide tubelets. Moreover, the compressed air hoses, which are designed somewhat longer than required in most cases, can be guided in a meandering fashion in the conduit. Because of the rotatability of the connecting piece it is possible to match it to the course of the hose.

Preferably, the connecting piece has a passage from which the air delivery conduit branches off. The passage is preferably provided with two connections which permit the placement of several connecting pieces, one behind the other in a compressed air line. The connections can be simple hose connectors on which an air hose is pushed.

The valve means arranged in the base body is preferably a ball valve with a ball made of plastic, for example neoprene. It is separated from the actuating element, i.e. not connected with it. The actuating element only has a tappet which, when the element is actuated, pushes the ball off its valve seat. Because of this, lateral play of the actuating element is of no importance for the seal of the valve in the closed state. In the non-actuated state there is a defined distance between the actuating element and the valve closing member. The valve will not yet open with a lateral force acting on the control knob, or with only a very slight actuation of the control knob.

The actuating element can be sealed by gap seals. This can be achieved, for example, by means of a rib-like projection on the control knob, which engages corresponding recesses of the base body. It is therefore made possible that no air escapes when the control knob is actuated by the operator.

The control knob, which is pushed, preferably has an edge, which engages a groove of the housing. A gap seal is formed in this way which prevents compressed air from flowing out in the direction of the operator side.

Moreover, simple disassembly, for example for cleaning, is possible by the separation of the actuating element and the valve closing member. The actuating element (control knob) can be designed in such a way that it snaps into the base body, wherein a fastening element, for example a snap-in tongue, is accessible from the outside, so that the control knob can be released from the base body.

The blower nozzle is preferably designed as a relatively long conduit of equal circumferential shape in order to allow the exit of a laminar air jet. The latter is very well bundled and in that way makes satisfactory yarn introduction possible, even into long yarn guide tubes.

A holder for a catch nozzle and a connection for the yarn guide tube are preferably provided on the base body. This holder can be a spring clamp, for example, which is embodied as one piece with the base body, which for example is made of plastic. The spring clamp prescribes an orientation for the catch nozzle and the yarn guide tube, which preferably coincides with the direction of the blower nozzle. In a preferred embodiment, this direction extends at an acute angle in respect to the base surface of the base body. Because of this, the yarn guide tube extends obliquely away from the base body into the profiled support element. It is thus made possible to place the yarn guide tubes inside the profiled support section. The result is a particularly smooth and simple construction, particularly if the yarn guide tubes, as well as the compressed air lines, are arranged on the profiled support section.

DETAILED DESCRIPTION OF THE PREFERRED EMBODIMENT

Figure 1:
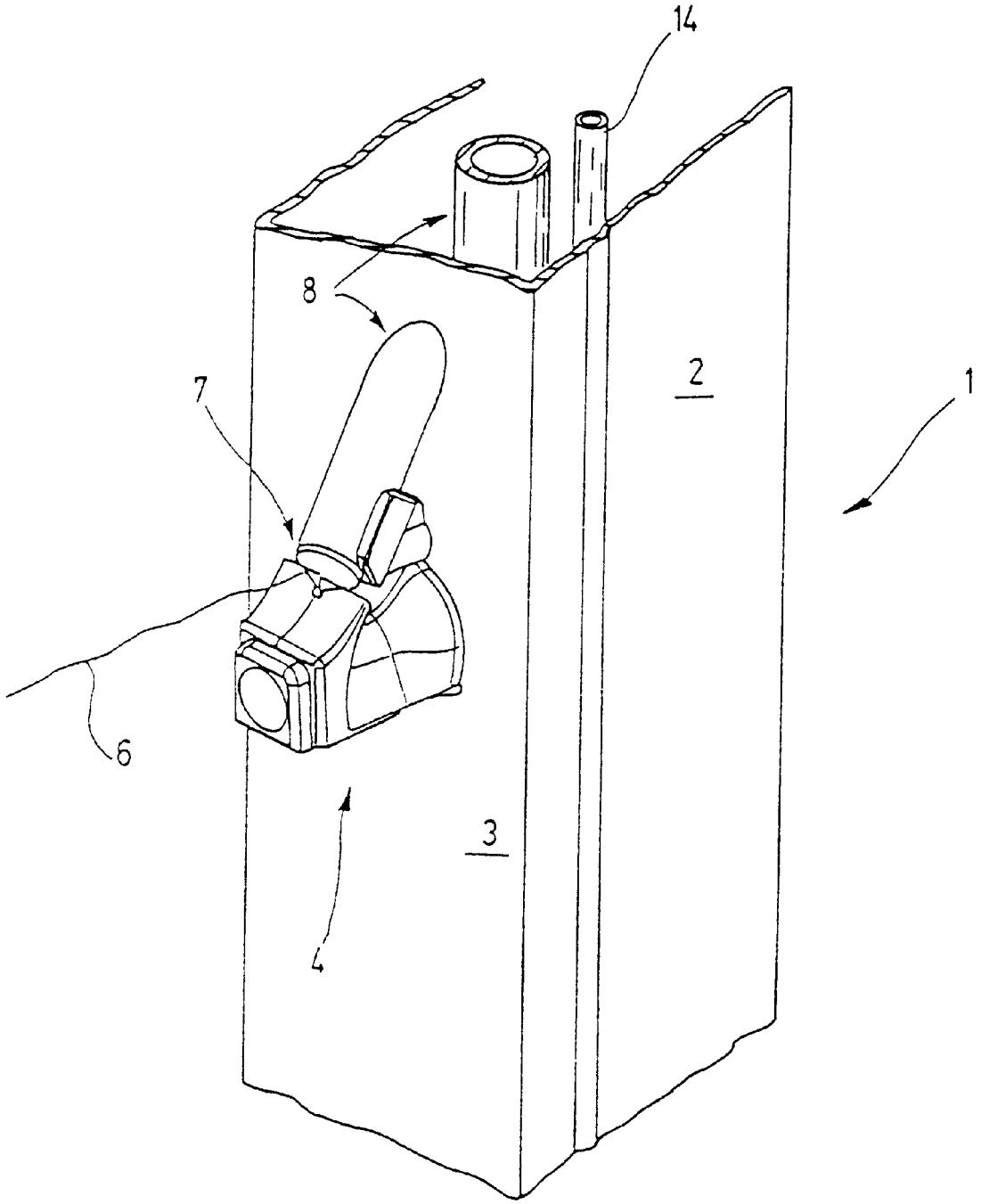
FIG. 1 shows a profiled support element with a yarn blow-in valve provided thereon in a partial perspective and schematic representation.

A support element 1 is represented in FIG. 1, which is provided on a bobbin creel, or can be a part thereof. For example, the support element 1 is a profiled plastic element, such as can be used as a cable conduit at other locations. The profiled plastic element can be closed, or open in the form of a U-shaped profile. In addition, it can have a groove-shaped base body 2 and an associated cover wall 3, which is locked together with the base body 2 for forming a closed profile.

A yarn blow-in valve 4 is arranged on the profiled support element 1, by means of which one end of a yarn 6, which comes from a yarn bobbin (not shown in detail) can be blown into an open end 7 of a yarn guide tube 8. The yarn guide tube 8 extends from the yarn blow-in valve 4, which is arranged in the vicinity of the yarn bobbin on a bobbin creel, into the vicinity of a yarn-receiving device, for example a yarn feeding device. The yarn guide tube 8 supports and guides the yarn 6. As represented in FIG. 1, the yarn guide tube 8 extends for the most part in the interior of the profiled support element 1. Thus, the outside of the latter is free of pipe lines.

Figures 2, 3:
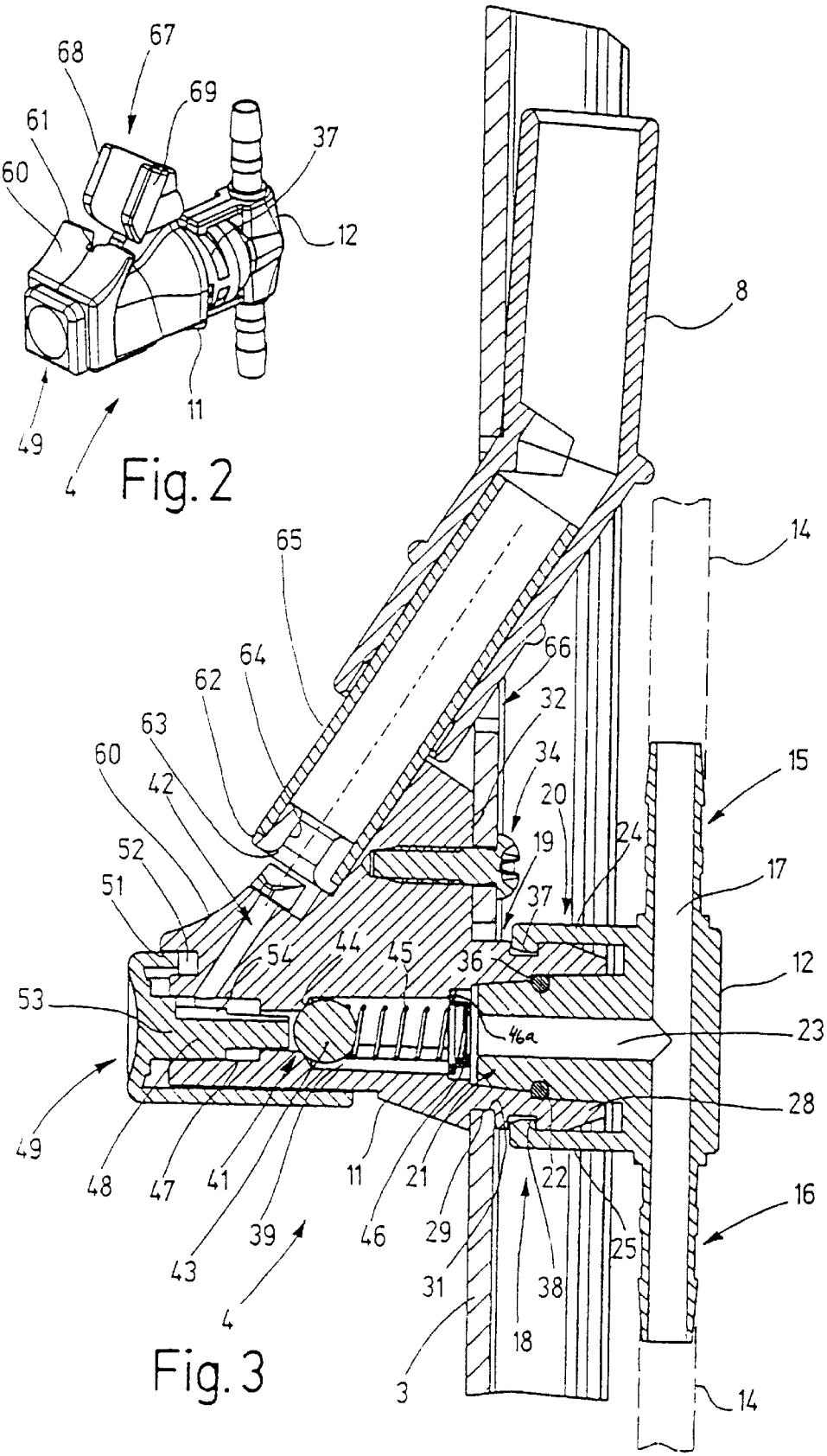
FIG. 2 shows the yarn blow-in valve of FIG. 1 in a perspective representation.
FIG. 3 shows the profiled support element of FIG. 1 in a longitudinal cross-sectional representation and on an enlarged scale.

The yarn blow-in valve 4 is depicted by itself in FIG. 2. It is also shown in FIG. 3. The yarn blow-in valve 4 is divided into a base body 11 and an associated connecting piece 12, which is used for making the connection with a compressed air line 14, which is only schematically sketched in FIG. 3 and can be seen in FIG. 1. For connection with air line 14, the connecting piece 12 has two extensions 15, 16 on oppositely located sides, which are tapered on the exterior and pipe-shaped, and are connected with each other by a passage 17.

The connecting piece 12 is connected by means of a coupling device 18 with the base body 11. A coupling member 19 on the side of the base body and a coupling member 20 on the connection side are part of the coupling device 18. Both coupling members 19 and 20 are designed to be complimentary in respect to each other, so that they fit into each other. The connecting piece 12 has a pipe-shaped neck 21, which conically tapers at its free end, for forming the coupling member 20. Following its conical area, an annular groove with an O-ring 22 seated therein, which is used as a seal, is provided on the neck 21. In addition, the pipe-shaped neck 21 includes therein an air delivery conduit 23, which branches off the passage 17 and terminates at the free end of the neck 21.

For mechanically securing the connecting piece 12 to the base body 11 and for maintaining the coupling members 19, 20 in a coupled, fluid-tight state, two flexible tongues 24, 25 are provided on the connecting piece 12 which extend approximately parallel to the neck in the direction toward the base body 11. The tongues are provided with a snap-in projection at their free ends. The flexible tongues 24, 25 are integral with the connecting piece 12 which, for example, is made of plastic. The free ends can be resiliently displaced away from the neck 21 or toward it.

The coupling member 19, which is a part of the base body 11, has a pipe-shaped neck 28, which projects through the closing or cover wall 3 at an assembly opening 29. Here, the pipe-shaped neck 28 is provided on at least one side with a groove-like receptacle 31, which extends behind the cover wall 3 at its opening 29. Otherwise the base body 11 rests with a level surface 32 against the cover wall 3. If required, it can be secured on the cover wall 3 by means of a fastening element, such as a screw 34, for example.

The pipe-shaped neck 28 of the coupling member 19 projects through the cover wall 3 and has an opening which is designed complementary to the exterior shape of the neck 21. An annular shoulder 36, which is sealed against the O-ring 22, is formed in the opening of the neck 28 approximately at the height of the O-ring 22. Moreover, the neck 28 fits on the neck 21 far enough, so that the latter is firmly seated in it. The neck 28 is provided with snap-in pockets 37, 38, which are engaged by the snap-in projections of the resilient tongues 24, 25 when the coupling members 19, 20 are in engagement with each other. In this way the snap-in pockets 37, 38 and the resilient tongues 24, 25 form a mechanical connecting device for the base body 11 and the connecting piece 12.

An air conduit 39 is formed in the base body 11, which leads from the coupling member 19 to a ball valve 41, and from there to a blow nozzle 42. The ball valve 41 is formed by a plastic ball 43, which is used as the valve closing member and to which a preferably conical annular surface 44 is assigned as the valve seat. The ball 43 is pushed against the annular surface 44 by a helical spring 45, wherein the helical spring 45 is supported on a securing element 46 seated in the air conduit 39. The securing element 46 is supported by means of extensions 46*a*, which are arranged obliquely in respect to the radial direction, on the smooth wall of the air conduit 39 and is thereby maintained in place.

Starting at the annular surface 44, the air conduit 39 extends into a step bore 47, in which a shaft 48 of an actuating member is seated. This is constituted by a control knob 49. The control knob 49 has a circumferential rim 51, which engages a corresponding, approximately fitting recess 52 of the base body. A relatively narrow gap is formed between the collar or rim 51 and the recess 52, both toward the outside as well as the inside. The end of the step bore, which forms the conduit 39, on the side of the control knob is closed by an end 53, which approximately matches the diameter of the air conduit 39, of the shaft 48 extending away from the control knob 49, ii such a way, that at most a relatively narrow gap remains between the bore and the end 53. The shaft 48 then extends at a slightly narrower diameter and/or with a longitudinal recess 54 provided for the purpose of letting air through, to the ball 43. The shaft 48 here is of such short dimensions that a space remains between the ball 43 and the front end of the shaft 48 when the control knob 49 is not actuated.

Figure 5:
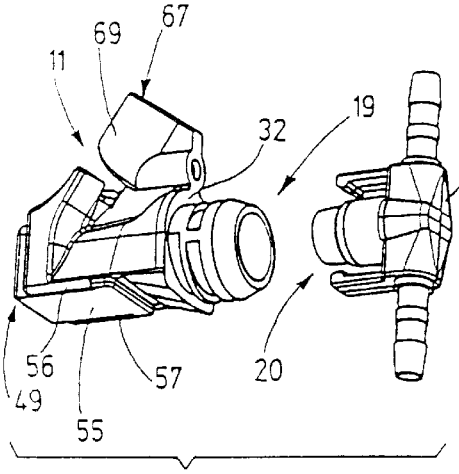
FIG. 5 shows the yarn blow-in valve of FIG. 4 in a perspective representation, with the connecting piece separated from the base body.
Figure 4:
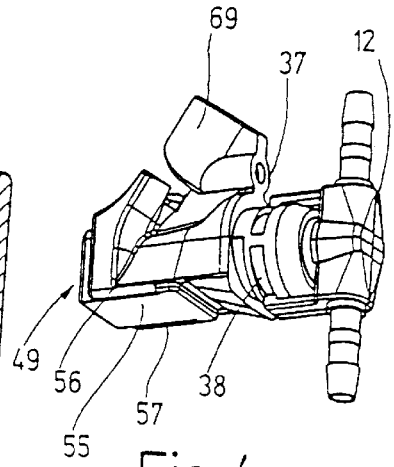
FIG. 4 shows the yarn blow-in valve of FIG. 2 in a perspective representation, viewed from a different direction.
Figure 6:
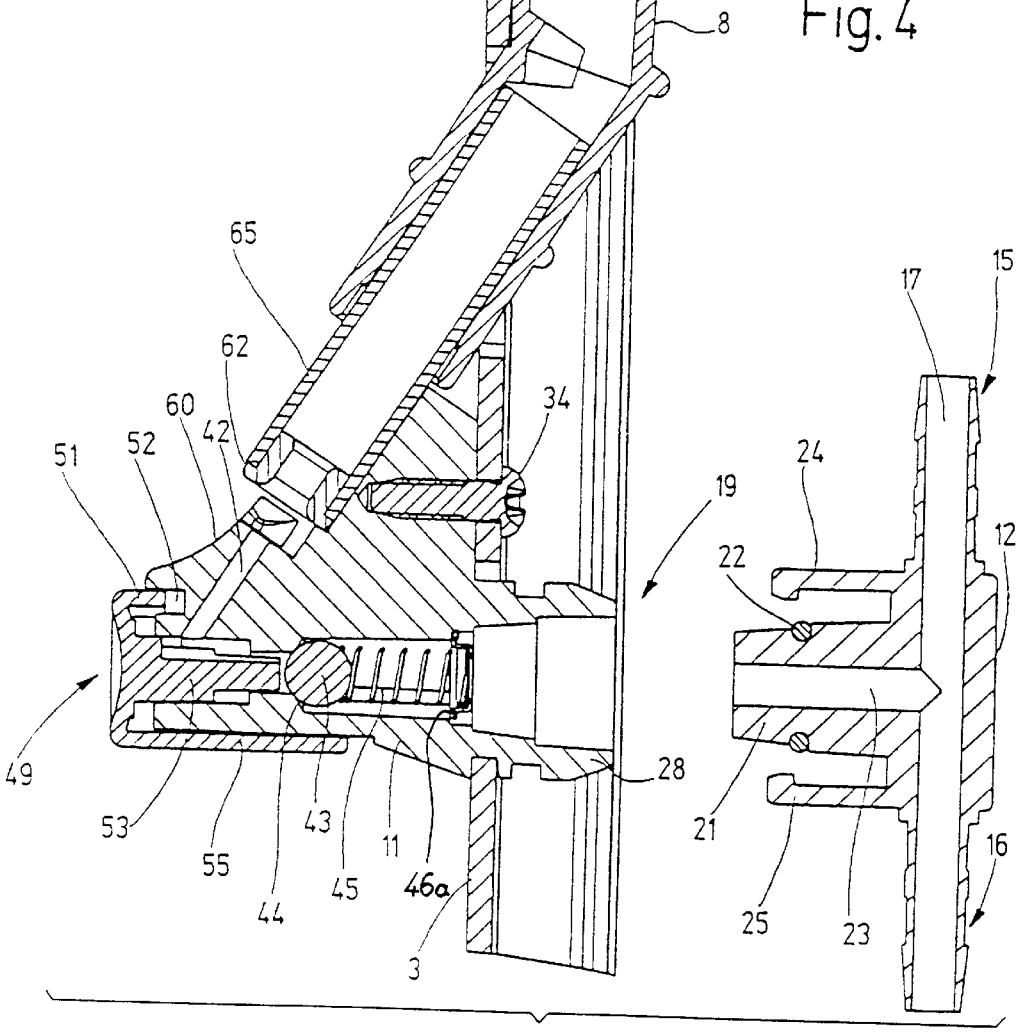
FIG. 6 shows a cross-sectional view of the profiled support element with a yarn blow-in valve, from which a connecting piece has been removed.
Figure 7:
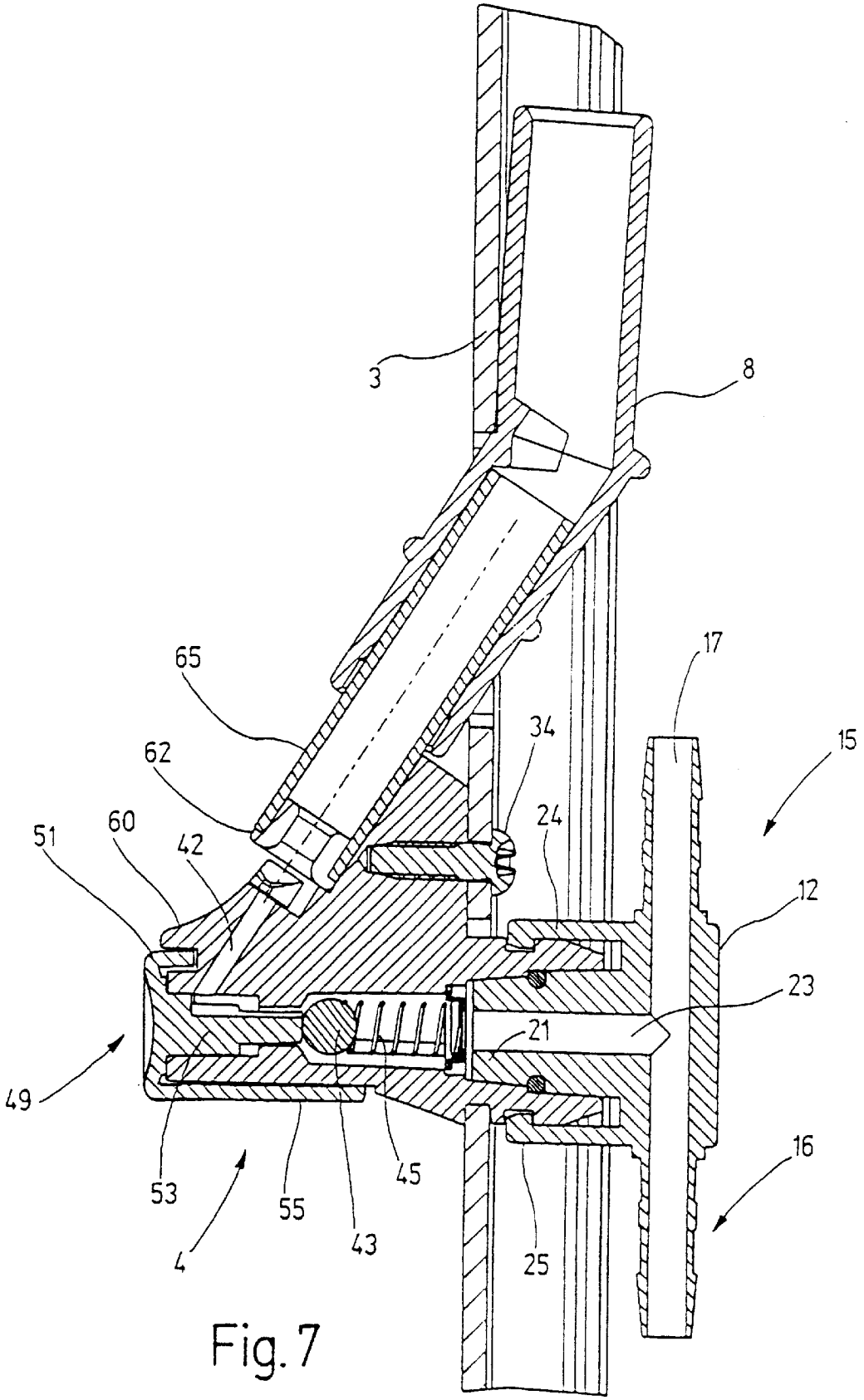
FIG. 7 shows the yarn blow-in valve mounted on a profiled support element as in FIG. 3, but with the control knob actuated.

The control knob 49 is provided with a securing tongue 55 on one side, which can be seen, for example, in FIGS. 4 and 5. The securing tongue 55 has a T-shaped head, which extends behind respective guide and contact ribs 56, 57 of the base body 11.The latter have been formed on the base body 11 parallel with the securing tongue 55 on both sides of it. The securing tongue 55 can be lifted out of the path defined between the two guide ribs 56, 57 in order to be able to remove the control knob 49 from the base body 11. However, in the relaxed state it rests against the base body 11 and maintains the control knob 49 on the base body 11 secure against loss and displaceable in the longitudinal direction.

The blow nozzle 42 branching off the air conduit 39 is constituted by a relatively narrow, for example cylindrical conduit, whose center axis forms an acute angle with the level surface 32. Thus, air exiting the blow nozzle 42 is blown obliquely toward the cover wall 3. The blow nozzle is located at some distance from the control knob 49 at one end of a concavely arched surface 60, which terminates in a narrow edge 61. A funnel-shaped cutout or a notch is formed in the edge 61, on whose bottom the mouth of the blow nozzle 42 is located. This is used for generating a directed air jet for introducing the yarn 6 into the yarn guide tube 8. The notch also takes out a portion of the arched surface 60, so that the blow nozzle 42 terminates in the immediate vicinity of the surface 60. Yarn can be guided easily and without obstacles to the blow nozzle 42 because of this.

A catch nozzle 62 is arranged opposite the blow nozzle 42, which has an arched, funnel-like tapering inlet area 63 and a cylindrical area 64 adjoining it (see FIG. 3). The catch nozzle 62 is seated in a guide tubelet 65, whose center axis coincides with the axis of the blow nozzle 42. However, the surface 60 leaves a portion of the inlet area 63 of the catch nozzle 62 free, so that yarn can be introduced into the suction gap formed between the catch nozzle 62 and the blow nozzle 42. This can take place from the right as well as from the left, so that the blow nozzle is not restricted to the operation by right-handed or left-handed persons.

The end of the guide tubelet 65 remote from the blow nozzle 42 is inserted into the yarn guide tube 8, which is arranged in the profiled support element 1 and projects through an appropriate opening 66 in profiled support element 1 to the outside. A spring clamp 67, which can be seen in FIG. 2 and is a part of the base body, is used for seating the guide tubelet 65 in place and to fix the catch nozzle 62 in the correct position in respect to the base body 11. The spring clamp 67 has two legs 68, 69 which, when in use, reach around the guide tubelet 65 and hold the guide tubelet 65 between them in a secure manner which, however, can be released when needed.

The yarn blow-in valve 4 described so far operates as follows:

The yarn blow-in valve is represented in the mounted state in FIGS. 1 and 3. The spring 45 presses the ball 43 against the annular surface 44, so that the air conduit 39 is closed. The control element 49 does not rest with its shaft 48 against the ball 43. The connecting piece 12 is coupled to the base body 11, so that the coupling members 19, 20 are in engagement with each other. The resilient tongues 24, 25 maintain the connecting piece 12 on the base body 11. Compressed air is present via the compressed air line 14 at the passage 17, and therefore the air delivery circuit 23. But the ball 43 blocks the air from access to the blow nozzle 42.

If yarn is to be blown into the yarn guide tube 8, the free end of the yarn is brought into the vicinity of the suction gap formed between the catch nozzle 62 and the blow nozzle 42. If now the control knob 49 is actuated by being pressed, the shaft 48 moves the ball 43 away from the annular surface 44. Consequently, compressed air is pushed through the blow nozzle and exits there as a strong air jet, which flows into the catch nozzle 62 and into the guide tubelet 65. The suction being formed there results in a relatively strong air flow over the arched surface 60, which pulls the yarn end into the suction gap and into the guide tubelet 65. The air jet now blows the yarn through the guide tube 8. In other words, the air flow coming from the blow nozzle 42 extends through the entire guide tube 8 and carries the yarn along.

When the control knob 49 is pushed, the air conduit 39 remains relatively well sealed against the exterior. The control knob 49 forms a triple gap seal with two buffer chambers. The first buffer chamber is defined underneath the control knob 49, while the second buffer chamber is bordered by the collar or the rib 51 and the corresponding recess 52. In this way almost all of the air pressure and the entire amount of compressed air which is conducted out of the compressed air line 14 is available to the blow nozzle 42. This results in a good blowing effect on the other hand is it possible to operate with relatively large tolerances. Because of the triple arrangement of the gap seals behind each other, it is possible to also tolerate somewhat greater gap widths without resulting in unacceptably high air losses.

I claim:

1. A yarn blow-in valve adapted to be mounted on a support element having at least one wall and shaped to define an interior space, said valve comprising:

a base body (11) adapted to be mounted outside of the interior space of the support element and having an air conduit (39), a blow nozzle (42), and a control member between said air conduit and said blow nozzle;

a connecting piece (12) having an air delivery conduit (23) and adapted to be mounted within the interior space of the support element for connection to said air conduit (39);

said base body and said connecting piece further comprising first and second coupling members, respectively, to secure the base body and connecting piece to each other through an opening in the at least one wall of the support element so as to form a fluid connection between said air delivery conduit (23) and said air conduit (39).

2. The yarn blow-in valve in accordance with claim 1, wherein the first and second coupling members (19, 20) are releasably connected with each other, to form a snap connection.

3. The yarn blow-in valve in accordance with claim 1, wherein the first and second coupling members (19, 20) are held together rotatably against each other.

4. The yarn blow-in valve in accordance with claim 1, further comprising snap-in means (24, 25, 37, 38) for mechanically securing the first and second coupling members (19, 20) to each other in a coupled state.

5. The yarn blow-in valve in accordance with claim 4, wherein said snap-in means (24, 25, 37, 38) comprises at least one resiliently arranged tongue (24, 25) arranged on one of said first and second coupling members (20) and which has a snap-in projection on its free end, and wherein the other of said first and second coupling members (19) includes at least one recess (37, 38) for receiving the snap-in projection.

6. The yarn blow-in valve in accordance with claim 1, wherein said first coupling member comprises a pipe-shaped neck formed on the base body (11), which projects away from an essentially level contact surface (32) of the base body and in which the air conduit (39) terminates.

7. The yarn blow-in valve in accordance with claim 6, wherein the second coupling member comprises a pipe-shaped neck (21) formed on the connecting piece (12), in which an air delivery conduit (23) terminates and which is insertable into the pipe-shaped neck (28) of the first coupling member (19), wherein the insertable pipe-shaped neck (21) is provided with a seal (22) adapted to form a connection between the air conduit (39) and the air delivery conduit (23) which is fluid-tight against the exterior when the first and second coupling members (19, 20) are coupled with each other.

8. The yarn blow-in valve in accordance with claim 1, further comprising fastening means provided on the connecting piece (12) which permit a seating of the connecting piece (12) which is fixed in place on or in a support element (3).

9. The yarn blow-in valve in accordance with claim 1, wherein the connecting piece (12) includes a passage (17) from which the air delivery conduit (23) branches off, and which has two oppositely located connectors (15, 16).

10. The yarn blow-in valve in accordance with claim 1, further comprising a valve means (43) in the base body (11) which selectively opens or closes the air conduit by actuating a control member (49) which includes a ball valve having a valve-closing member that is not connected with an actuating element, and wherein the control member (49) comprises at least one sealing device for sealing the air conduit against the environment.

11. The yarn blow-in valve in accordance with claim 1, wherein the base body (11) comprises a fastening device (34) for maintaining said base body in place on a support (3).

12. The yarn blow-in valve in accordance with claim 1, wherein said blow nozzle (42) on the base body (11) is arranged inclined with respect to a mounting plane determined by a base surface (32) of the base body (11).

13. The yarn blow-in valve in accordance with claim 1, wherein said base body (11) comprises a catch nozzle (62) which is releasably maintained on the base body (11).

14. The yarn blow-in valve in accordance with claim 13, wherein said base body (11) comprises a spring clamp (67) for holding the catch nozzle (62), and wherein the catch nozzle (62) is insertable into a yarn guide tube (8).

* * * * *